US005259672A

United States Patent [19]

Rowe

[11] Patent Number: 5,259,672

[45] Date of Patent: Nov. 9, 1993

[54] SHAKING TABLE HAVING DIRECT ELECTROMAGNET DRIVE

[75] Inventor: Arthur J. Rowe, Leicester, Great Britain

[73] Assignee: University of Leicester, Leicester, England

[21] Appl. No.: 834,261

[22] PCT Filed: Aug. 6, 1990

[86] PCT No.: PCT/GB90/01223

§ 371 Date: Apr. 14, 1992

§ 102(e) Date: Apr. 14, 1992

[87] PCT Pub. No.: WO91/02585

PCT Pub. Date: Mar. 7, 1991

[30] Foreign Application Priority Data

Aug. 17, 1989 [GB] United Kingdom ..... 8918779

[51] Int. Cl.[5] ..... B01F 11/00

[52] U.S. Cl. ..... 366/111; 366/116; 366/127; 366/208; 335/219; 335/285; 335/289

[58] Field of Search ..... 366/108, 110-112, 366/116, 127, 208, 209, 215, 216, 349, 600; 335/285, 288-290, 219-220

[56] References Cited

U.S. PATENT DOCUMENTS

| | | | |
|---|---|---|---|
| 1,739,349 | 12/1929 | Blain . | |
| 1,945,015 | 1/1934 | Wurzbach et al. | 366/127 X |
| 4,061,315 | 12/1977 | Eitzen et al. | 366/111 |
| 4,118,801 | 10/1978 | Kraft et al. | 366/111 |
| 4,202,634 | 5/1980 | Kraft et al. | 366/111 |
| 4,305,668 | 12/1981 | Bilbrey | 366/208 X |
| 4,750,845 | 6/1988 | Nabetani | 335/219 X |
| 5,060,151 | 10/1991 | Mikyska et al. | 366/308 X |

FOREIGN PATENT DOCUMENTS

| | | | |
|---|---|---|---|
| 0037955 | 10/1981 | European Pat. Off. . | |
| 1673287 | 3/1971 | Fed. Rep. of Germany . | |
| 3046157 | 7/1982 | Fed. Rep. of Germany | 366/108 |
| 934278 | 5/1948 | France . | |
| 980886 | 5/1951 | France | 335/219 |
| 2352579 | 12/1977 | France . | |
| 167003 | 5/1965 | U.S.S.R. | 366/110 |
| 580916 | 11/1977 | U.S.S.R. | 366/127 |
| 1433845 | 10/1988 | U.S.S.R. | 366/116 |
| 1546127 | 2/1990 | U.S.S.R. | 366/108 |
| 1216604 | 12/1970 | United Kingdom | 366/127 |
| 2057903 | 4/1981 | United Kingdom . | |
| 2211268 | 6/1989 | United Kingdom | 366/111 |

*Primary Examiner*—Harvey C. Hornsby
*Assistant Examiner*—Charles Cooley
*Attorney, Agent, or Firm*—Oblon, Spivak, McClelland, Maier & Neustadt

[57] ABSTRACT

A shaking table for laboratory use for agitating liquid in flasks has at least one direct electromagnetic drive, for example, opposed pairs of electromagnets (14, 15) arranged orthogonally. A control device may control pulse frequency and amplitude to the electromagnets to produce different shaking modes. A plurality of drive members connected to an articulation mechanism are movable by the electromagnets, the articulation mechanism being mounted to the table. The table is mounted to a base by a plurality of flexible posts.

7 Claims, 1 Drawing Sheet

SHAKING TABLE HAVING DIRECT ELECTROMAGNET DRIVE

TECHNICAL FIELD

This invention relates to shaking tables such as are used in laboratories to agitate liquid in flasks.

Such tables conventionally comprise a motor driving a cam, crank or eccentric, which acts on the table top, and are subject to the usual requirements for prolonged satisfactory operational life of such "moving part" mechanical components, which means they are expensively constructed and/or require frequent maintenance and repair. They are also not very controllable.

DISCLOSURE OF THE INVENTION

The present invention provides a shaking table which does not have these disadvantages.

The invention comprises a shaking table having a direct electromagnetic drive, characterised by comprising a base mounting electromagnet coil means and armature means moved by said coil means and connected to a table top, supported on the base by flexible post means.

The table top may be a snap fit on the armature.

The table may have separate electromagnet means for effecting movement in different directions, and may have two opposed pairs of electromagnet means arranged orthogonally.

The table may comprise drive means pulse-energizing said electromagnet coil means.

Control means for the drive means may be adapted to control pulse frequency and/or amplitude, and may also alter the energizing pulse pattern whereby to produce different shaking modes.

BRIEF DESCRIPTION OF THE DRAWINGS

Embodiments of shaking tables according to the invention will now be described with reference to the accompanying drawings, in which.

BEST MODE OF CARRYING OUT THE INVENTION

Figure 1:
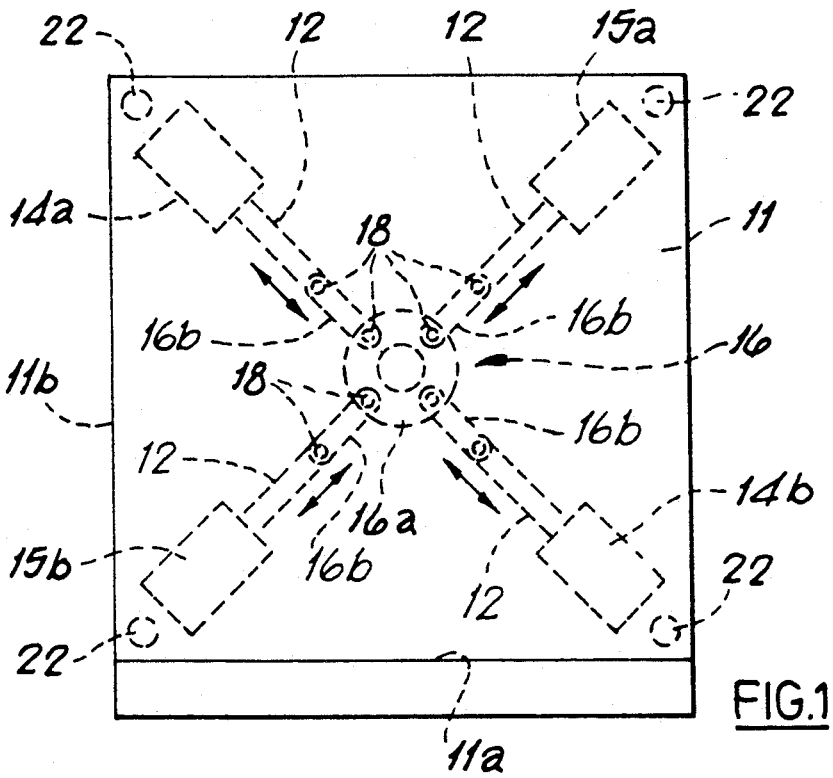
FIG. 1 is a plan view of one embodiment.
Figure 2:
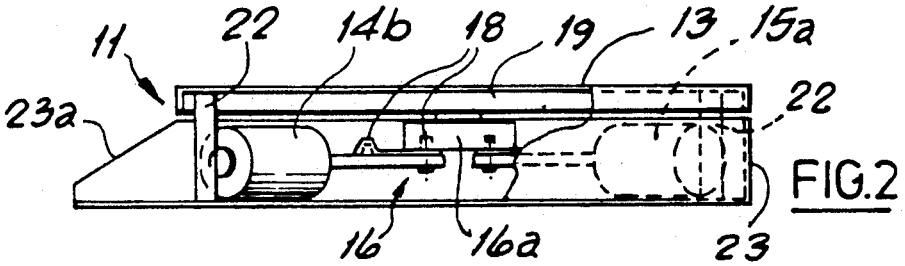
FIG. 2 is a partly sectional elevation of the embodiment of FIG. 1.
Figure 3:
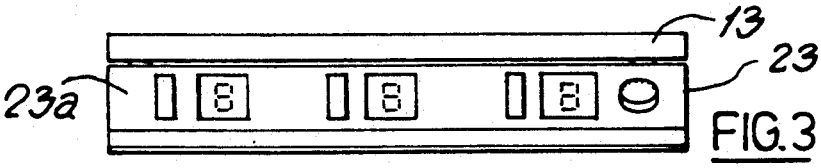
FIG. 3 is a front elevational view of the embodiment of FIG. 1.

The drawings illustrate a shaking table having direct electromagnet drive members 12. The table 11 has a bi-directional shaking motion, that is to say, regarding one edge 11*a* of the table 11 as an x-axis and an adjacent edge 11*b* as a y-axis, shaking movement of the table top 13 takes place in both x- and y-directions.

The table 11 has separate electromagnet means 14*a*, 14*b*, 15*a*, 15*b* effecting movement in different directions. Each separate electromagnetic means comprises an opposed pair 14*a*, 14*b*; 15*a*, 15*b* of electromagnets, the pairs being arranged orthogonally to each other. The pairs 14*a*, 14*b* or 15*a*, 15*b* are arranged diagonally on the table 11.

An articulating mechanism 16 includes connecting links 16*b* which are respectively connected to a hub 16*a* by pairs of snap fitting joints 18. The hub 16*a* is then attached to the table top 13.

Flour flexible corner posts 22 stand up from the table 11 and project slightly above the main housing 23 thereof. The top 13 locates on the upper ends of the posts when it is engaged on the mechanism 16, so that movements of the mechanism 16 are reflected in movements of the table top 13 on the flexible posts 22.

It will now be seen that energizing either magnet of the pair 14*a*, 14*b* will move the table top 13 along the diagonal towards that magnet, and likewise for the other magnet pair 15*a*, 15*b*. The hub 16*a* is articulated by having connecting links 16*b* pivotally connected to the hub 16*a* to allow such movement.

It will now be seen at once that sequentially switching the magnets 14*a*, 15*a*, 14*b*, 15*b* will effect a corresponding movement of the table top.

The snap fit of the top 13 to the hub 16*a* enables it to be removed for cleaning and for servicing access to the housing 23.

Figure 4:
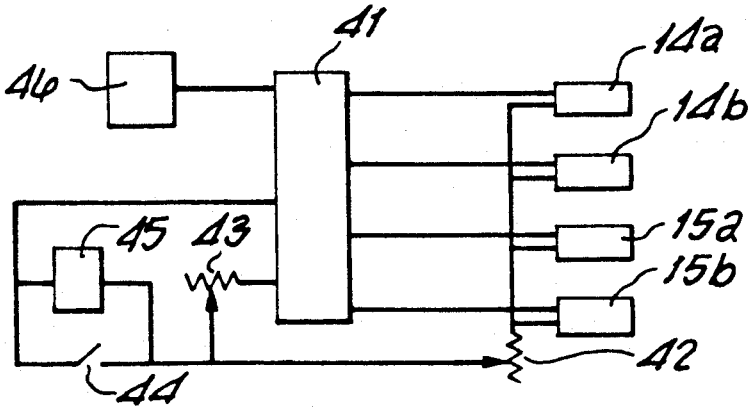
FIG. 4 is a diagrammatic illustration of a driving and controlling arrangement.

The driving and controlling arrangement illustrated in FIG. 4 is very much like a stepper motor drive arrangement and comprises a sequencing logic circuit 41 driving the electromagnets 14*a*, 15*a*, 14*b*, 15*b* sequentially. An amplitude control 42, which might be a decade switch, controls the pulse current through each magnet, and a frequency control 43, which might also be a decade switch, controls the frequency with which the circuit 41 sequences through the switching cycle. A manual on/off 44 is provided in parallel with a timer 45 which can be used to pre-set a shaking time and switch off and/or give an audible warning on termination.

This may be a luxury, but it is possible to incorporate a shaking mode selector 46 which simply alters the switching pattern of the sequencer logic so that any of several shaking modes may be selected such, for example, as a straightforward circular mode in which the magnets are energized in the order 14*a*, 15*a*, 14*b*, 15*b* (or the reverse) or a unidirectional mode in which only magnets 14*a* and 14*b* are used, or a mode in which the unidirectional mode diagonal changes periodically, and so on.

The various controls are conveniently brought out to a front panel 23*a* of the housing 31, which, of course, accommodates the driving and controlling arrangement of FIG. 4 as well as the necessary power pack and mains transformer.

It would, of course, be possible to simplify the design considerably. For example, three electromagnets could be used instead of four, and these three might be arranged at the apexes of an equilateral triangle; or designs could be envisaged using only two electromagnets and indeed only one such, on a push-pull basis or with a spring bias, which would be limited as regards its shaking modes but probably nonetheless effective for most purposes.

A similar electromagnetic drive could also be used to drive a flask stirrer.

I claim:

1. A shaking table having a direct electromagnet drive, which comprises:

a base;

at least one electromagnet mounted on the base;

an articulation mechanism connected to a drive member, said drive member being connected to and movable by said electromagnet;

a table top to which the articulation mechanism is connected; and a plurality of flexible posts for supporting the table top on the base.

2. A shaking table according to claim 1, wherein said at least one electromagnet comprises a plurality of electromagnets for effecting movement of said articulation mechanism in different directions.

3. A shaking table according to claim 2, wherein said plurality of electromagnets comprise two opposed pairs of electromagnets arranged orthogonally to one another.

4. A shaking table according to claim 1 which comprises drive means for pulse energizing said at least one electromagnet.

5. A shaking table according to claim 4, which comprises frequency control means for control of said drive means.

6. A shaking table according to claim 4, which comprises amplitude control means for control of said drive means.

7. A shaking table according to claim 1 which comprises shaking mode selector means for controlling operation of said at least one electromagnet.

* * * * *